US007783245B2

(12) United States Patent
Nakamichi et al.

(10) Patent No.: US 7,783,245 B2
(45) Date of Patent: Aug. 24, 2010

(54) BOOK-BINDING APPARATUS AND IMAGE FORMING SYSTEM

(75) Inventors: Motoki Nakamichi, Hachioji (JP); Tetsuo Hirata, Hachioji (JP); Norishige Kato, Hachioji (JP); Takehiro Ogushi, Hachioji (JP); Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 959 days.

(21) Appl. No.: 11/586,675

(22) Filed: Oct. 26, 2006

(65) Prior Publication Data

US 2007/0175386 A1 Aug. 2, 2007

(30) Foreign Application Priority Data

Jan. 24, 2006 (JP) ..... 2006-014802

(51) Int. Cl.
*B42C 9/00* (2006.01)

(52) U.S. Cl. ..... 399/408; 412/6

(58) Field of Classification Search ..... 399/408; 412/6, 8, 33; *B42C 9/00*
See application file for complete search history.

(56) References Cited

U.S. PATENT DOCUMENTS

| | | | | |
|---|---|---|---|---|
| 7,527,465 | B2 * | 5/2009 | Toyoizumi et al. | 412/37 |
| 2004/0194894 | A1 * | 10/2004 | Takagi et al. | 156/546 |
| 2009/0133619 | A1 * | 5/2009 | Tsuchiya et al. | 118/261 |

FOREIGN PATENT DOCUMENTS

| | | |
|---|---|---|
| JP | 08-225196 | 9/1996 |
| JP | 09-077310 | 3/1997 |
| JP | 11-208939 | 8/1999 |
| JP | 2004209744 A * | 7/2004 |

* cited by examiner

*Primary Examiner*—Judy Nguyen
*Assistant Examiner*—Jennifer Simmons
(74) *Attorney, Agent, or Firm*—Finnegan, Henderson, Farabow, Garrett & Dunner, L.L.P.

(57) ABSTRACT

A book-binding apparatus having: a reception vessel to receive glue in liquid form; application section to apply the glue in the reception vessel to a sheet; a hopper to receive a raw material of the glue for refill; a refilling section to refill the raw material of the glue from the hopper to the reception vessel; and a control section to control the refilling section, wherein the raw material of the glue is refilled into the reception vessel in a period where application of the glue is not carried out after application of the glue is completed.

14 Claims, 6 Drawing Sheets

BOOK-BINDING APPARATUS AND IMAGE FORMING SYSTEM

This application is based on Japanese Patent Application No. 2006-14802 filed on Jan. 24, 2006, in Japanese Patent Office, the entire content of which is hereby incorporated by reference.

BACKGROUND OF THE INVENTION

The present invention relates to an image forming system and a book-binding apparatus.

An image forming apparatus having electronic photographing method has been utilized in a field of short-run printing such as POD (Print On Demand) by using its high-speed performance.

In the field of short-run printing, as an embodiment of image forming apparatus, there is disclosed image forming systems in Patent Documents 1 to 3 to execute a job from printing to book-binding in a single process by combining an image forming apparatus and a book-binding apparatus.

Patent Document 1: Japanese Unexamined Patent Application Open to Public Inspection No. Tokkaihei 8-225196

Patent Document 2: Japanese Unexamined Patent Application Open to Public Inspection No. Tokkaihei 9-77310

Patent Document 3: Japanese Unexamined Patent Application Open to Public Inspection No. Tokkaihei 11-208939

In the book-binding apparatuses of Patent Documents 1 to 3, sheets conveyed from an image forming apparatus one by one are bundled to form a sheet bundle composed of a plurality of the sheets and glue is applied on a spine of the sheet bundle to form a booklet.

Different form ordinary book-binding apparatuses which carry out book-binding in a process separated from printing process, this type of book-binding apparatus is designed to be compact since it is used in combination with the image forming apparatus and an process amount of booklets is relatively small.

With the above reasons, the book-binding apparatuses of Patent Documents 1 to 3 also have a configuration in which a glue application section to apply the glue on the sheet moves along a spine to apply glue, which makes it possible to downsize an apparatus.

In such compact book-binding apparatus, a reception vessel to receive the glue to be applied is also compact, consequently the glue has to be refilled relatively frequently. Meanwhile, as the glue used for the aforesaid compact book-binding apparatus, because handling is relatively easy, hot melt glue which melts by heat is used. In case a glue composed of hot melt adhesive is used, a raw material of the glue in solid pellet form is received in a hopper once then the pellets are refilled from the hopper to the reception vessel in sequence and then the pellets are heated and melt to liquid glue to be applied.

Now, there is a case that a temperature of the glue decreases right after the pellets are refilled and a temperature distribution of the glue in the reception vessel becomes uneven, then if the glue is applied right after the pellets are refilled, the glue is applied unevenly and uniform application of the glue cannot be realized. In the aforesaid image forming system utilizing the small reception vessel, refilling of the raw material of the glue is carried out frequently and a problem such as uneven application has to be solved.

SUMMARY OF THE INVENTION

An object of the present invention is to solve the aforesaid problem of uneven application of the glue without decreasing a job efficiency of book-binding.

The aforesaid object is achieved by the following structures.

(1) A book-binding apparatus including: a reception vessel to receive a glue in liquid condition; an application section to apply the glue in the reception vessel on a sheet; a hopper to receive a raw material of the glue for refilling; a refilling section to refill the raw material of the glue from the hopper to the reception vessel; and a control section to control the refilling section, wherein the raw material of the glue is refilled into the reception vessel in a period after application of the glue is completed wherein application of the glue is not carried out.

(2) An image forming system, including: an image forming device to form an image on a sheet; and the book-binding apparatus having; the reception vessel to receive the glue in liquid form, the application section to apply the glue in the reception vessel to the sheet, the hopper to contain the raw material of the glue, the refilling section to refill the raw material of the glue from the hopper to the reception vessel, and the control section to control the refilling section, wherein the raw material of the glue is refilled into the reception vessel in the period where application of the glue is not carried out after application of the glue is completed.

DESCRIPTION OF THE PREFERRED EMBODIMENT

While the present invention is explained using embodiments shown by figures, the present invention is not limited to the embodiments herein.

<Image Forming System>

Figure 1:
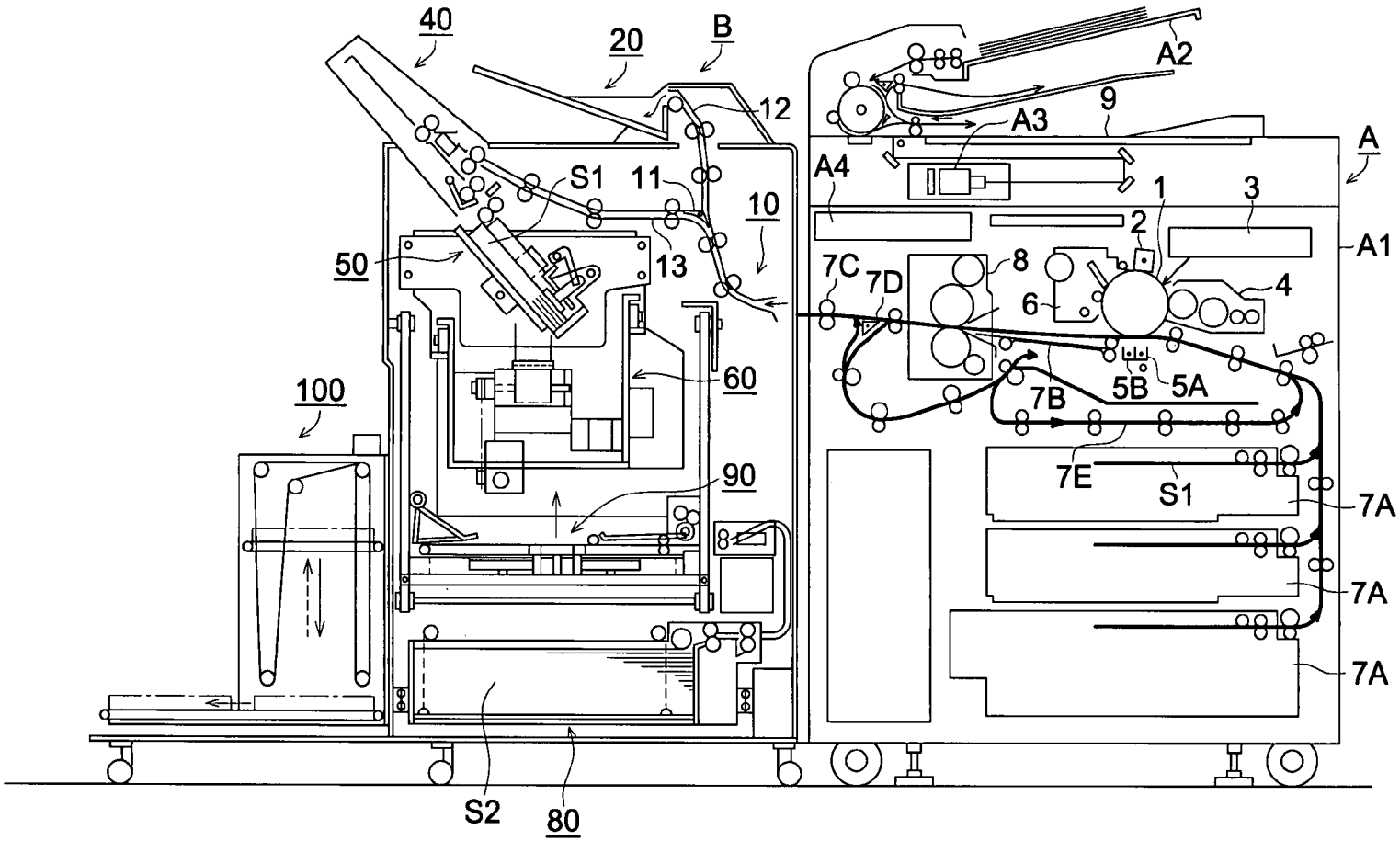
FIG. 1 is a drawing indicating a total view of an image forming system related to an embodiment of the present invention.

FIG. 1 is a drawing showing a total view of an image forming system related to an embodiment of the present invention.

The image forming system having image forming apparatus A and book-binding apparatus B carries out a job from image forming to book-binding in a consistent process in which image forming apparatus A forms an image on a sheet, and then book-binding apparatus B forms a sheet bundle and binds the sheet bundle.

Image forming apparatus A having image forming section A1, document conveyance device A2, image scanning section A3 and communicating section A4, forms the image on the sheet through an electronic photographing method.

In image forming section A1, there are arranged charging device 2, exposing device 3, developing device 4, transferring device 5A, separating device 5B and cleaning device 6 in a circumference of drum-shaped photo conductor 1, and these electronic photo process devices carry out charging, exposing, developing and transferring so as to form a toner image on photo conductor 1 and to form an image on sheet S1.

Sheet S1 is stored in three feeding trays 7A and sheet S1 is fed one piece by one piece from these feeding trays 7A, and the toner image on photo conductor 1 is transferred onto sheet S1 by transferring device 5A.

The toner image transferred onto sheet S1 is fixed by fixing device 8. Sheet S1 after fixing is processed is discharged from discharge roller 7C or conveyed to sheet re-feeding path 7E.

Switching gate 7D guides and switches sheet S1 for face-down sheet discharging in one-side printing, face-up sheet discharging in one-side printing and for obverse image forming in two-side printing. Namely, in case of face-up sheet discharging, switching gate 7D guides sheet S1 to go straight and in case of face-down sheet discharging, switching gate 7D guides sheet S1 to go downward.

In face-down sheet discharging, after sheet S1 is guided downward, it is switched back to be conveyed upward and discharged from discharging roller 7C.

In two-side image forming, sheet S1 is guided downward and turned over by switching back, then through sheet re-feeding path 7E, it is conveyed again to the transferring section where transferring device 5A is provided to carry out transferring of a reverse side image.

Document conveyance device A2 conveys the documents to a scanning position one by one. Image scanning section A3 scans a document conveyed by document conveyance device A2 or a document placed on document plate 9, and it creates an image signal. Communication section A4 communicates with network deices to receive image forming commands and forms the image signal.

Book-binding apparatus B bundles a plurality of sheets-conveyed from image forming apparatus A to make a bundle of sheets and covers the bundle with a cover sheet to make a booklet. In the following explanation, a sheet on which an image is formed by image forming apparatus A, to be supplied to book-binding apparatus B is called sheet S1, a cover sheet is called cover sheet S2 and a booklet wherein the sheets are covered with a cover sheet is called booklet S3.

Book-binding apparatus B has conveyance section 10 so as to convey sheet S1 discharged from image forming apparatus A to discharging tray 20 or to sheet reversal section 40, sheet discharging tray 20, sheet reversal section 40 representing a supplying section to supply sheet S1 to sheet accumulating section 50, sheet accumulating section 50 to accumulate sheet S1 conveyed one by one or by several sheets, application section 60, front cover storing section 80 to store front cover S2, front cover supporting section 90 to support the front cover, and booklet discharge section 100.

Sheet S1 discharged from image forming apparatus A is guided by switching gate 11 provided at conveyance section 10 and discharged to discharging tray 20 through discharging path 12 or conveyed to sheet reversal section 40. Except for a case of book-binding process mode, sheet S1 is discharged to discharging tray 20.

In book-binding mode, sheet S1 is conveyed to sheet reversal section 40 through conveyance path 13, then after switching back in sheet reversal section 40, sheet S1 is conveyed to sheet accumulation section 50. In sheet accumulation section 50, a predetermined number of sheets S1 are accumulated. When the predetermined number of sheets S1 are accumulated, sheet accumulation section 50 tunes and retains a bundle of sheets S1 practically vertically.

The glue is applied by application section 60 on a bottom surface of the bundle of sheets S1 retained by sheet accumulation section 50 vertically.

Cover sheet S2 comes in contact with the bundle of sheets S1 on which the glue is applied, to be bonded.

Booklet S3 formed by bonding cover sheet S2 on the bundle of sheets S1 is discharged to booklet discharging section 100.

<Book-Binding Apparatus>

Figure 2:
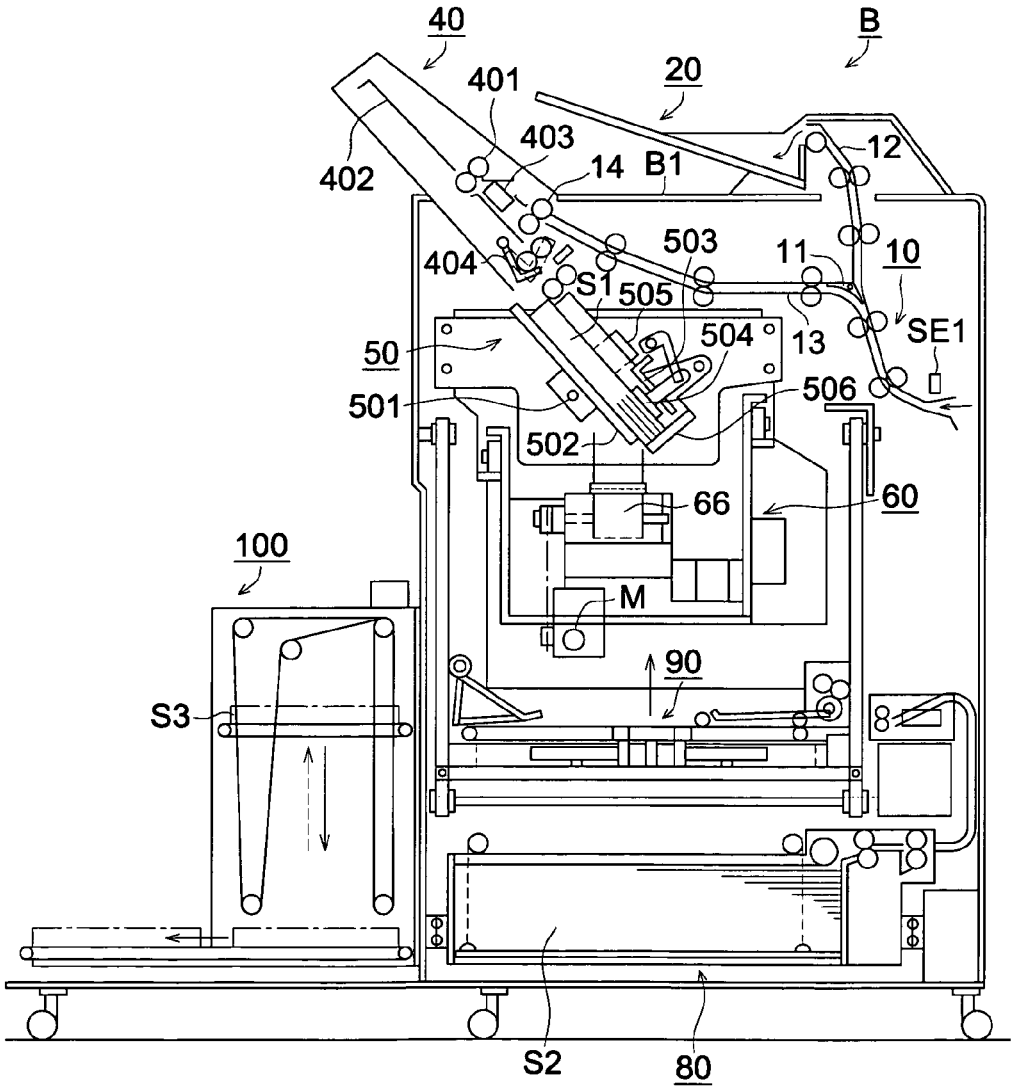
FIG. 2 is a front cross-sectional view of a book-binding apparatus related to an embodiment of the present invention.

Each section of book-binding apparatus is explained with reference to FIG. 2 and FIG. 3. FIG. 2 is a front cross-sectional view of a book-binding apparatus B related to an embodiment of the present invention.

Sheet SI conveyed through conveyance path 13 is conveyed by reception roller 14 and goes through conveyance roller 401, then after sheet S1 rises along reversal guide plate 402 having a slanted support surface to support and guide sheet S1, conveyance roller 401 rotates to conveyed sheet S1 downward.

Numeral 403 representing an aligning member to align sheet S1 on reversal guide plate 402, reciprocates in a conveyance direction by driving a motor. Numeral 404 representing a stopper which is used when a plurality of sheet S1 are accumulated in sheet reversal section 40, can be set at a retraction position shown by a solid line and at a sheet reception position shown by broken lines. At the retraction position shown by the sold line, sheet S1 is not accumulated on reversal guide plate 402 and sheet S1 is accumulated on reversal guide plate 402 when the sheet guide plate 402 is set at the sheet reception position shown by the broken lines. Aligning guide plate 403 operates in case the sheet is accumulated on reversal guide plate 402 and aligns the sheet in a width direction of conveyance. Aligning guide plate 402 and stopper 404 configure a buffer sheet accumulation section to accumulate sheet S1 at a stage before sheet S1 is accumulated in sheet accumulation section 50. Sheet S1 conveyed downward falls in sheet accumulation section 50 to be accumulated. Sheet accumulation section 50 has receiving plate 506 and supporting plate 502 having a slanted accumulating surface, and sheet S1 coming down along sheet reversal section 40 is supported by supporting plate 502 and receiving plate 506 in a slanted condition. Sheet S1 sequentially discharged from image forming apparatus A is accumulated in sheet accumulation section 50 and the bundle of sheets S1 is formed. Number of sheets S1 forming the bundle is set in setting section 68. Numeral 504 representing an urging member to hold rising of accumulated sheet S1 moves up and down so as to hold sheet S1. Numeral 505 representing an aligning member aligns a side edge of the sheet.

At a stage where sheet S1 is accumulated, urging member 503 operates to support the bundle of sheets S1 in between supporting plate 502 and urging member 503.

While the bundle of sheets S1 is being supported, sheet accumulation section 50 turns with axis 501 as a turning axis to shift a status of the bundle of sheets S1 from a slanted status to a vertical status.

Figure 3:
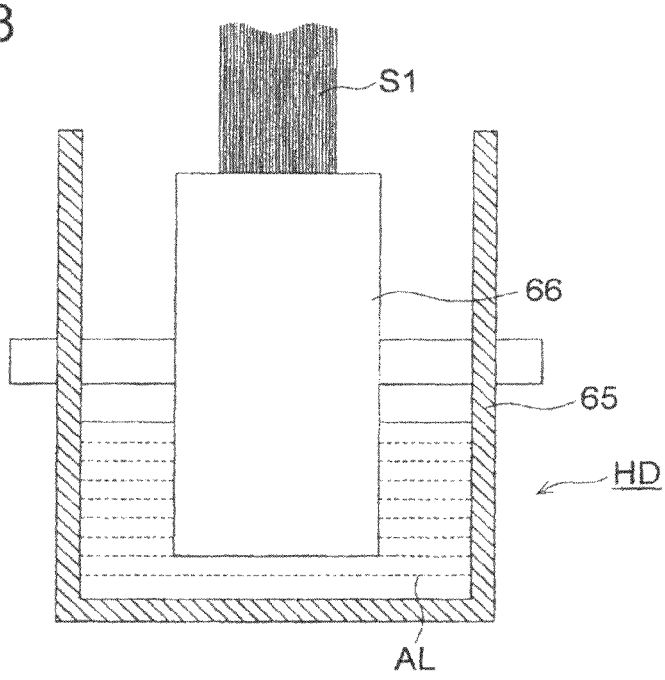
FIG. 3 is a drawing indicating glue application head HD in a process of applying glue.

FIG. 3 shows glue application head HD in a process to apply the glue while the bundle of sheets S1 is supported in vertical condition in sheet accumulation section 50.

Glue application head HD that is located at a home position (supposing that the page surface of FIGS. 2 and 3, is horizontal, the home position locates under the page surface in Z axis direction) representing an initial position, is moved from the home position through driving by motor M when a book-binding process starts. In the course of this movement, applying roller 66 that is located at a lower position and constitutes the application section is separated from a bottom surface of the bundle of sheets S1.

Then, when glue application head HD reaches a turning position, it returns back to the home position by reversing motor M. In this process, as FIG. 3 shows, application roller 66 rises to contact with the bottom surface of sheet S1 and applies glue AL. Namely, in the present embodiment, glue application head HD does not carry out the glue application in a course of forward stroke but carries out the glue application in a course of backward stroke. Meanwhile, application has to be carried out at least in one stroke within forward stroke or backward stroke.

Cover sheet S2 supplied by cover sheet storing section 80 and supported by cover sheet supporting section 90 rises to be contacted and bonded with sheet S1 on which the glue is applied, thus booklet S3 is formed. Booklet S3 is discharged to booklet discharging section 100.

<Refilling of the Glue>

Figure 4:
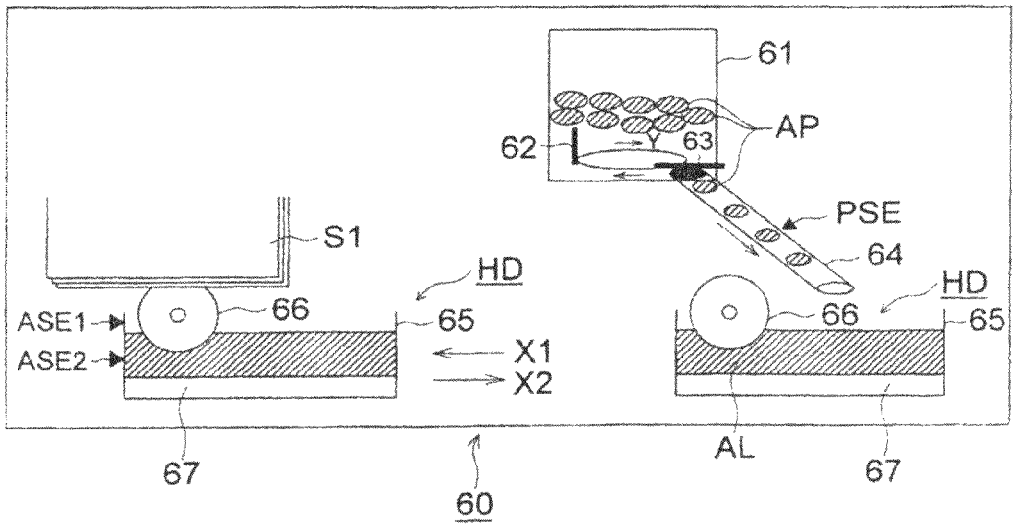
FIG. 4 is a schematic drawing indicating glue application action in an application section.

FIG. 4 is a schematic drawing indicating glue applying operation in an application section.

Application section 60 has hopper 61, glue application head HD and refilling tube 64. Glue application head HD reciprocates as arrows X1 and X2 show to apply the glue on a bottom side representing a spine of the bundle of sheets S1.

Hopper 61 has stirring member 62 which stirs by rotation movement as arrow Y shows so that smooth filling of pellet AP is not disturbed by disproportion of pellet AP in hopper 61.

Hopper 61 is provided with shutter 63 on a bottom and connected with refilling tube 61. Shutter 63 and refilling tube 61 configure a refilling section where shutter 63 opens an entrance of refilling tube 64 to let pellet AP fall into reception vessel 65 for refilling.

On refilling tube 64, there is provided pellet sensor PSE representing a refilling quantity detection sensor to detect passing of pellet AP and pellet AP passing through refilling tube 64 is detected. By counting a quantity of the pellets detected by pellet sensor PSE, the predetermined quantity of pellets are refilled in a single refilling action. When shutter 63 is opened by a glue refilling signal, if passing of pellet AP is not detected by pellet sensor PSE, stirring member 62 operates to stir the pellets in hopper 61, and then, the glue refilling signal appears again and refilling of the glue is retried. Since refilling of the raw material of the glue in the predetermined quantity into a reception vessel is carried out constantly, application of the glue is always stable.

Such refilling of pallets AP is carried out after glue application head HD completes applying process and returns to the home position on right end position and it becomes stationary. In this status, reception vessel 65 locates right under the discharging port of refilling tube 64 and pellet AP refilled falls into reception vessel 65.

Glue application head HD has, reception vessel 65, applying roller 66 and heater 67.

Pellet AP refilled in reception vessel 65 is heated up to a predetermined temperature and melts into liquid. While the liquid glue is in reception vessel 65, glue application head HD is moved from the home position at right end in FIG. 4 by driving motor M as X1 shows, and in the course of the backward stroke shown by X2, applying roller 66 contacts with the spine of sheets S1 to apply glue AL on sheets S1.

In glue application head HD, there is provided a remaining quantity detecting sensor to detect a remaining quantity of the glue AL in reception vessel 65. In the example shown by the figure, thermal sensors ASE1 and ASE2 to detect temperatures of a sidewall of reception vessel 65 at different heights are utilized as the remaining quantity detecting sensor to detect remaining quantity of the glue. When the remaining quantity of the glue decrease and a temperature detected by thermal sensor ASE1 locating at a higher position decreases, it is detected that the remaining quantity of the glue is not more than a predetermined value. Meanwhile, for example, a sensor such as a optical sensor optically detects a liquid surface of the glue AL can also be utilized as the remaining quantity sensor.

When thermal sensors ASE1 and ASE2 detect that the remaining quantity becomes not more than the predetermined value by consumption of glue AL through application, pellet AP is refilled from hopper 61 to reception vessel 65. This refilling is not carried out while glue application head HD is in application operation. Namely, refilling is not carried out while glue application head HD is shifting, and is carried out when glue application head HD returns to the home position i.e. right end position in FIG. 4 and is stationary. In other words, after applying action of the glue on the bundle of sheets S1 and before starting applying action of the glue on a next bundle of sheet, pallet AP is refilled.

The quantity of pellet AP passing inside refilling tube 64 is detected by detection of pellet sensor PSE, and the predetermined quantity of pellet AP is refilled into reception vessel 65 in a single refilling action.

Pellet AP is refilled into reception vessel 65, and after refilled pellet AP is heated by heater 67 and melts into liquid, glue application head HD moves to apply the glue. Thus uniform application of the glue is realized.

As FIG. 4 shows, contrary to reciprocating movement of glue application head HD, hopper 61 is fixed at the home position of glue application head HD and glue application head HD is separated from refilling tube 64 when glue application is executed. With this structure, it is possible that glue application head HO is made compact and the quantity of pellet AP stored in hopper 61 can be increased, thus the book-binding apparatus can be operated for long period of time with a single refilling from outside.

Figure 5:
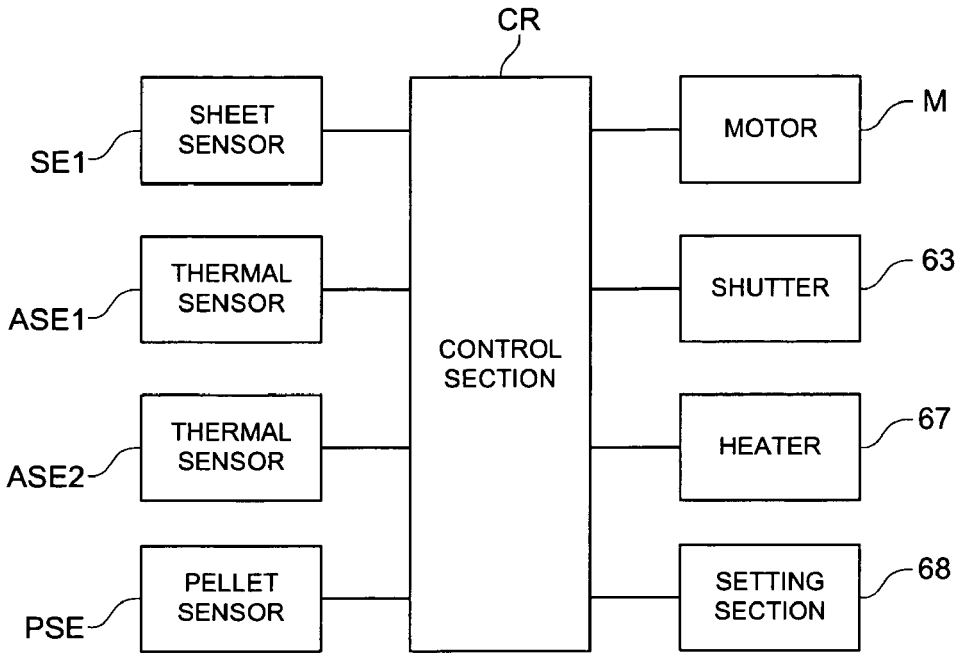
FIG. 5 is a block diagram of a control system to control the glue application and refilling of a raw material of the glue.
Figure 6:
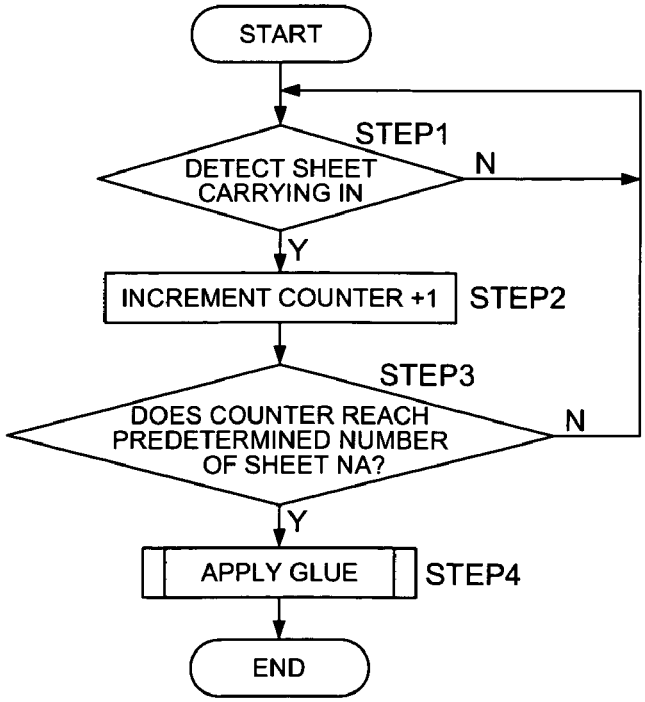
FIG. 6 is a flow chart of the glue application control.
Figure 7:
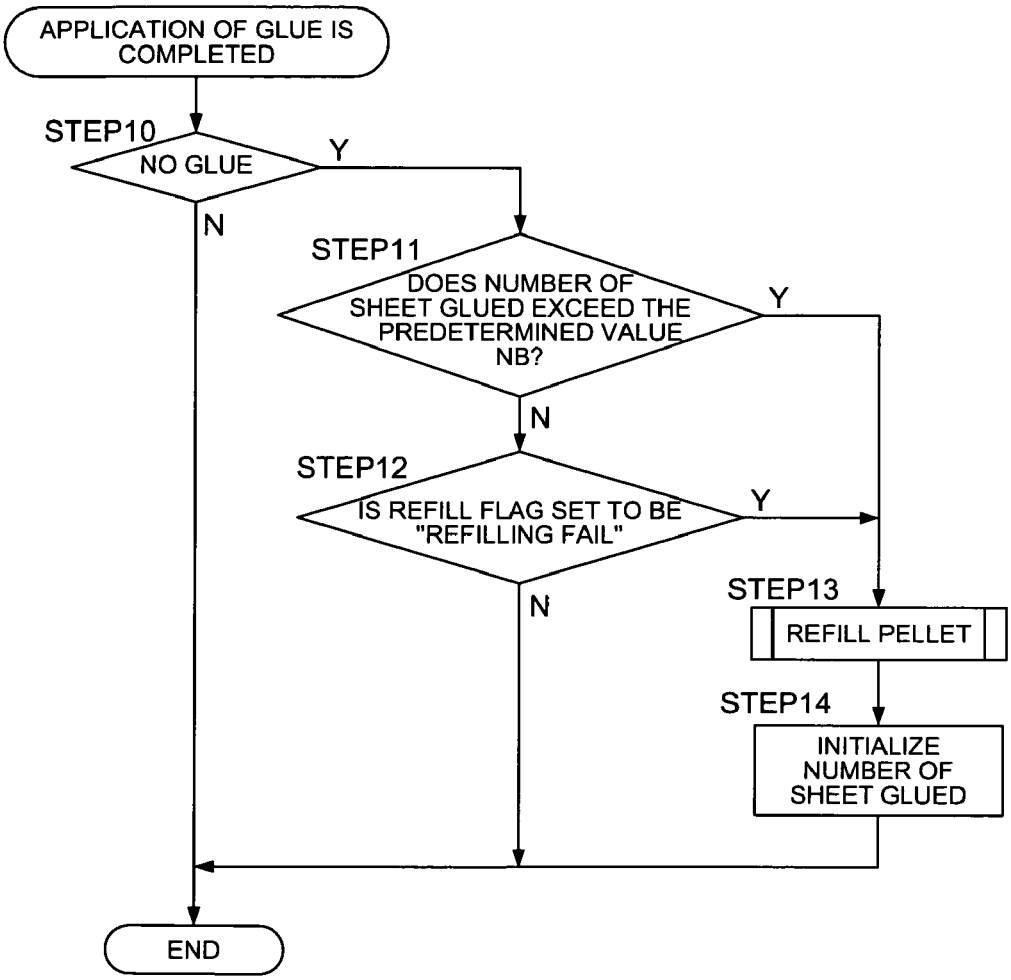
FIG. 7 is a flow chart of refilling of the raw material of the glue.
Figure 8:
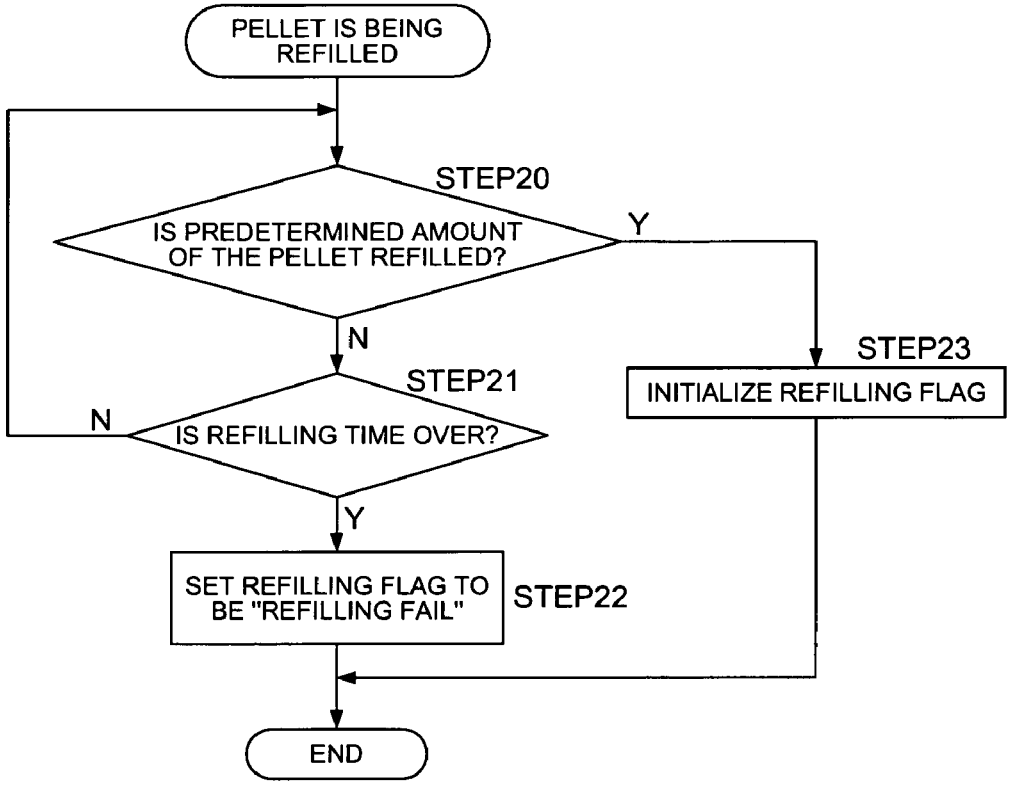
FIG. 8 is a flow chart of retry action in the course of refilling of the raw material of the glue.

FIG. 5 is a block diagram of a control system to control application of the glue and refilling of the raw material of the glue explained as follows. FIG. 6 is a flow chart of glue application control. FIG. 7 is a flow chart of refilling control of the raw material of the glue, and FIG. 8 is a flow chart of retry action in the course of refilling of the raw material of the glue. Control indicated in FIG. 6 to FIG. 8 is carried out by control section CR.

In STEP 1 of FIG. 6, carrying-in of sheet S1 to book-binding apparatus B is detected by sheet sensor SE1 provided at a carrying-in entrance. Every time when sheet S1 is carried in, a counter is incremented by +1 to count number of sheets S1 carried in.

When the number of sheets counted by counter reaches a predetermined number for a booklet, (Y in STEP 3), as explained above, control section CR starts motor M to move glue application head HD to carry out glue application action (STEP 4).

FIG. 7 shows how to control when the remaining quantity of the glue in reception vessel 65 shows the predetermined value or less after the glue is consumed through the glue application mentioned above. Meanwhile, the control in the flow chart in FIG. 7 is executed for every completion of glue application for one bundle of sheet.

When the remaining quantity of glue AL comes to a predetermined value or less and an empty signal appears (Y of STEP 10), the number of the sheets glued is judged whether it exceeds a predetermined value or not.

The predetermined number of the sheets glued NB indicates capacity of reception vessel 65 to apply the glue, and it means the number of the sheets glued during the period from the moment when glue AL in reception vessel 65 is full to the moment when the sheets are judged to be empty in STEP 10, which is predetermined in advance, in accordance with a size of sheet S1, Therefore, the number of sheets glued to be judged in STEP 11 is a number of sheets S1 counted from the moment of the latest filling of pellet AP into reception vessel 65.

If the size of sheet is large and a gluing length is long, the predetermined number of sheets glued NB decreases and if the size of sheet is small and the gluing length is short, the predetermined number of sheets increases.

In STEP 11, in case the number of sheets glued does not reach the predetermined number of sheets glued NB (N of STEP 11), pellet AP does not have to be refilled into reception vessel 65. Then, a refill flag is judged whether or not it is set to be "refilling fail" in STEP 12, and if it is not set to be "refilling fail" (N of STEP 12), pellet refilling operation flow in FIG. 7 is terminated.

The refilling flag, as explained later using FIG. 8, is set to be "refilling fail" when refilling of the pellet is failed. In case of "refilling fail" in STEP 12 (Y of STEP 12), since the control section judges an empty status of the glue, even if the number of sheets glued does not reach the predetermined number of sheets glued NB in STEP 11, the refilling action to refill the pellet into reception vessel 65 is executed in STEP 13.

Also, in STEP 10, if the remaining quantity of the glue is detected that it is less than the predetermined value (Y STEP 10) and the number of sheets glued reaches to predetermined value NB (Y of STEP 1), pellet AP is refilled into reception vessel 65 in STEP 13. An action in STEP 13 is to open shutter 63 in FIG. 4 and at the same time of opening shutter 63, stirring member 63 is driven to agitate for ensuring pellet AP to be refilled.

After pellet 13 is refilled in STEP 13, the number of sheets glued is initialized (STEP 14).

Next, operation where pellet AP is not refilled from hopper 61 to reception vessel 65 normally, is explained with reference to FIG. 8.

It is monitored that whether or not the prescribed quantity of pellet AP is refilled from hopper 61 to reception vessel 65, and if it is refilled (Y of STEP 20), setting of the refilling flag for "refilling fail" is cancelled and initialized to terminate (STEP 23). Since pellet sensor PSE detects passing of the pellet inside refilling tube 64, the refilling quantity of pellet AP is detected by counting the detection signal of pellet sensor PSE. When the count reaches the predetermined value, judgment in STEP 20 becomes Y.

In case the refilling quantity of pellet AP does not reach the predetermined value (N of STEP 20), a refilling time is judged if it exceeds a predetermined refilling time established in advance, or not. If it exceeds (Y of STEP 21), the refilling flag is set to be "refilling fail" (STEP 22).

By combining the control in FIG. 7 and FIG. 8, retry of refilling pellet AP from hopper 61 to reception vessel 65 is carried out. Namely, when the refilling flag is set to be "refilling fail" in STEP 20 to 22 in FIG. 8, because of incomplete of refilling, refilling is judged to be failed (Y) in STEP 12 in FIG. 7 and refilling is carried out in STEP 13.

According to the aforesaid embodiments, since the raw material of the glue is refilled in a period where the glue is not applied and application of the glue is carried out in a condition where the glue in the reception vessel is thoroughly melting, uniform application of the glue is realized. Consequently a high quality booklet where the sheets are firmly bonded each other is made. Also, because application of the glue is not interrupted by a lack of the glue, a book-binding apparatus and an image forming system which operate highly efficiently can be realized.

What is claimed is:

1. A book-binding apparatus comprising:

a reception vessel to hold glue in a liquid form;

an application section to apply the glue in the reception vessel to a sheet;

a hopper to receive a raw material of the glue for refilling;

a refilling section to refill the raw material of the glue from the hopper to the reception vessel; and a control section to control the refilling section, which refills the raw material of the glue into the reception vessel based on whether the glue application to a predetermined number of the sheets is completed by using the flue in the reception vessel in a period where glue application is not carried out after glue application is completed wherein the control section controls the refilling section to stop refilling the raw material of the glue when a predetermined refilling time is over.

2. The book-binding apparatus of claim 1, wherein, the glue is a hot melt type adhesive, the raw material of the glue refilled from the hopper to the reception vessel is in solid form, and a heater to heat and melt the raw material of the glue is provided in the reception vessel.

3. The book-binding apparatus of claim 1, wherein after application of the glue to a first bundle of the sheets, in a period before application of the glue to a second bundle of the sheets, the refilling section is controlled to refill the raw material of the glue into the reception vessel.

4. The book-binding apparatus of claim 3, wherein the predetermined number of the sheets is changed in accordance with size of the sheet.

5. The book-binding apparatus of claim 1, wherein the hopper is arranged to be stationary, the reception vessel and the application section are arranged on an application head which can move from an initial position, glue application is carried out by moving the application head, and refilling of the raw material of the glue from the hopper to the reception vessel is carried while the application head is in the initial position.

6. The book-binding apparatus of claim 5, wherein the application head can reciprocate between the initial position and a turning position, the application section applies the glue to the sheet at least in the course of an outward stroke or a backward stroke of a reciprocation, the hopper is arranged near the initial position, and refilling of the raw material of the glue from the hopper to the reception vessel is carried out at the initial position.

7. The book-binding apparatus of claim 5, wherein the refilling section has a reception vessel and a refilling tube extending from the hopper to the initial position, and while the application head is located at the initial position, the reception vessel is close to the refilling tube and while the application head is moving, the reception vessel is receded from the refilling tube.

8. The book-binding apparatus of claim 5, further comprising a remaining quantity detecting device to detect a remaining quantity of the glue in the reception vessel, wherein the control section controls the refilling section to refill the raw material of the glue when the application head comes to the initial position at a first time after the remaining quantity detecting device detects that the remaining quantity of the glue is less than a predetermined value.

9. The book-binding apparatus of claim 1, wherein the application section has an application roller.

10. The book-binding apparatus of claim 1, wherein the control section controls the refilling section to refill again in case the raw material is not refilled in a predetermined quantity.

11. The book-binding apparatus of claim 10, wherein the control section controls the refilling section to refill again after carrying out glue application to a new sheet, in case the raw material is not refilled in the predetermined quantity.

12. The book-binding apparatus of claim 10, wherein the reception vessel and the application section can reciprocate between an initial position and a turning position, the hopper is arranged in a vicinity of the initial position, the application section applies the glue to the sheet at least in a course of an outward stroke or a backward stroke of a reciprocation, and in case the predetermined quantity of the raw material of the glue is not refilled, after the application section applies the glue on a new bundle of the sheet by reciprocating, the control section controls the refilling section to refill again when the application section returns at the initial position.

13. The book-binding apparatus of claim 10, further comprising a raw material refilling quantity detecting device, wherein in one refilling action of the raw material of the glue, if a quantity detected by the refilling quantity detecting device does not reach the predetermined quantity, the control section controls the refilling section to refill again.

14. An image forming system, comprising:

an image forming device to form an image on a sheet; and a book-binding apparatus having;

a reception vessel to hold a glue in liquid form, an application section to apply the glue in the reception vessel to the sheet, a hopper to contain a raw material of the glue, a refilling section to refill the raw material of the glue from the hopper to the reception vessel, and a control section to control the refilling section, which refills the raw material of the glue into the reception vessel in a period where glue application is not carried out after glue application is completed wherein the control section controls the refilling section to stop refilling the raw material of the glue when a predetermined refilling time is over.

* * * * *